US006231646B1

(12) United States Patent
Schweizer et al.

(10) Patent No.: US 6,231,646 B1
(45) Date of Patent: May 15, 2001

(54) PAINT OVERSPRAY EXHAUST AIR FILTER

(75) Inventors: Rand Schweizer, Park Ridge, IL (US); James W. Motter, Toledo, OH (US)

(73) Assignee: Chemco Manufacturing Company, Inc., Northbrook, IL (US)

( * ) Notice: Subject to any disclaimer, the term of this patent is extended or adjusted under 35 U.S.C. 154(b) by 0 days.

(21) Appl. No.: 09/266,504

(22) Filed: Mar. 11, 1999

(51) Int. Cl.[7] ..... B03C 3/30

(52) U.S. Cl. ..... 96/17; 55/486; 55/528; 55/DIG. 39; 55/DIG. 46; 96/58

(58) Field of Search ..... 96/17, 57, 58, 96/52, 53, 364; 55/DIG. 46, DIG. 39, 528, 486

(56) References Cited

U.S. PATENT DOCUMENTS

| | | | | |
|---|---|---|---|---|
| 3,599,399 | * | 8/1971 | Gallen | 55/DIG. 46 |
| 4,237,780 | * | 12/1980 | Truhan | 55/DIG. 46 |
| 4,308,223 | | 12/1981 | Stern | 264/436 |
| 4,323,374 | * | 4/1982 | Shinagawa et al. | 96/58 |
| 4,493,718 | * | 1/1985 | Schweizer | 55/DIG. 46 |
| 4,530,274 | * | 7/1985 | Lyons et al. | 55/DIG. 46 |
| 4,626,263 | | 12/1986 | Inoue et al. | 55/DIG. 39 |
| 4,874,659 | | 10/1989 | Ando et al. | 55/528 X |
| 4,917,942 | * | 4/1990 | Winters | 55/DIG. 39 |
| 4,927,437 | | 5/1990 | Richerson | 55/349 |
| 4,955,990 | | 9/1990 | Napadow | 55/DIG. 46 |
| 4,973,341 | | 11/1990 | Richerson | 55/461 X |
| 5,037,455 | * | 8/1991 | Scheineson et al. | 96/17 |
| 5,039,313 | * | 8/1991 | Gocht | 55/DIG. 46 |
| 5,051,118 | | 9/1991 | Andreae | 55/521 X |
| 5,419,953 | * | 5/1995 | Chapman | 96/17 X |
| 5,554,416 | * | 9/1996 | Scheufler et al. | 55/DIG. 46 |
| 5,641,555 | | 6/1997 | Berrigan et al. | 128/206.19 X |
| 5,643,507 | | 7/1997 | Berrigan et al. | 264/DIG. 48 |
| 5,658,640 | | 8/1997 | Berrigan et al. | 428/903 X |
| 5,658,641 | | 8/1997 | Berrigan et al. | 428/903 X |
| 5,726,107 | | 3/1998 | Dahringer et al. | 442/414 |

OTHER PUBLICATIONS

Print–outs relating to "FLO–CLEAN EM 2000" from Internet Web Site: http://www.affco.com, Jan. 2, 1999.

Print–out relating to Glossary of terms from Internet Web Site: http://www.laflamme.on.ca/web/glosse.html, Jan. 2, 1999.

Article entitled "American Lung Association|Air Cleaning Devices: Types of Air Cleaning Processes" from Internet Web Site: http://www.lungusa.org/pub/cleaners/air_clean_chap3.html, Feb. 25, 1999.

* cited by examiner

*Primary Examiner*—Richard L. Chiesa
(74) *Attorney, Agent, or Firm*—Mason, Kolehmainen Rathburn & Wyss

(57) ABSTRACT

A paint overspray exhaust air filter for air laden with liquid paint overspray particulates being exhausted from an overspray paint booth includes an electrostatic charged or electret media used in conjunction with and positioned downstream of a primary high efficiency, high holding capacity overspray collection filter. The overspray air filter is designed to capture and retain virtually all of that overspray particulates contained in the air stream being exhausted from an overspray paint booth. The upstream overspray collection filter can include a single filter or additionally a secondary filter, but should be optimized to collect the overwhelming majority of the overspray particulates of a given size whereas the downstream electret media is adapted to collect overspray particulates that are smaller than the given size. The upstream overspray collection filter and the electret media can be separated or mechanically attached together.

12 Claims, 1 Drawing Sheet

PAINT OVERSPRAY EXHAUST AIR FILTER

BACKGROUND OF THE INVENTION

1. Field of the Invention

The present invention relates to a filter media for removing liquid airborne particulates from an air stream and, more particularly, to a new and improved filter media for removing liquid paint overspray particles from air streams being exhausted from a paint spray booth, the filter media including both an overspray collection filter and an electret type of electrostatic filter.

2. Background of the Invention

Spray booths are used in a variety of industrial applications for applying paint to many different products. A number of different spray atomizing application techniques can be used in such spray booths. One of these techniques is an air atomization technique wherein coating or paint particles are mixed with an air stream being ejected from a spray gun and the air stream is directed to the product being coated. Another technique is an airless atomization technique wherein the coating material is atomized and propelled by hydraulic pressure to the product being coated. Yet another technique is an electrostatic spraying technique. The product to be coated is grounded and the coating material is atomized (either by an air or airless technique) and is electrically charged. As a result, the coating materials are deposited on the product due to the electrical attraction of charged coating particles to the product being coated.

Regardless of the spray technique that is used, a paint spray booth is commonly employed to contain evaporating solvents and to capture airborne atomized paint particles so as to minimize their impact on the environment and to protect painters from being unnecessarily exposed to the solvents and paint particles used in the coating process, particularly those that may be toxic. In fact, the use of spray booths is normally required for most liquid paint spray applications by federal or state regulatory agencies, including in particular, the Environmental Protection Agency. Moreover, spray booths tend to enhance the quality of the finish being applied to a product being coated by providing a clean environment for the application of liquid coatings to these products.

In such spray booths, it is necessary to maintain a consistent, steady and uniform flow of air throughout the booths. Among other things, the consistent air flow prevents the accumulation of partially dried overspray on an object being coated so that the appearance of the object is not marred and tends to assist in providing the product with a quality finish. Moreover, spray booths prevent the accumulation of hazardous concentrations of potentially explosive solvent vapors. In fact, environmental clean air standards require that the emissions from spray booths must not include more than certain levels of particulates.

To remove paint particulates from the air being exhausted from a spray booth, the common practice is to employ a replaceable fibrous filter which will trap the overwhelming majority of these paint particulates. These filters soon become clogged with such particulates so that the air flow through the spray booth tends to be substantially reduced, thus decreasing the air flow past the worker inside the booth and the products being coated. Moreover, the spray booth has to be shut down to replace such clogged filters (once per eight hour shift is not uncommon) and the fibrous filters are not inexpensive.

While it may not be readily apparent, the capture and retainment of droplets of liquid coatings is technically very different and significantly more complex than filtering dry particles from moving air streams in connection with, for example, a HVAC (heating, ventilating and air-conditioning) system. The spectrum of materials commonly referred to as coatings or paints that are used in a spray booth exhibit a broad range of physical characteristics. Some UV-cured coatings have low viscosities approximating water whereas some commercial high solids coatings have viscosities ranging from molasses to peanut butter. Some coatings dry in seconds at ambient temperatures whereas many thermoset or baking enamels will literally never dry at normal plant ambient temperatures.

Unlike dust and most other dry particles that need to be entrapped in a filter, paint overspray is comprised of wet, atomized, paint droplets typically ranging in size to as large as 30 microns in diameter. As more and more of these particles are being entrapped by an overspray filter, the captured wet particles tend to adhere to each other to the point where they may succumb to the force of gravity and begin migrating down through the filter media. These and other related, unique technical aspects of overspray arrestance demonstrate that the filtration of paint overspray from moving air streams is significantly different and more complex than the filtration of dust and dry particles from moving air streams. In fact, many of the companies in the overspray filtration market are not the same companies in the dust collection and general air filtration markets.

In recent years, advancements in microelectronics has significantly improved the performance capabilities of scientific test instrumentation used in evaluating filtration of overspray paints and the like. In particular, the commercial availability of computerized particle counters has made it possible to measure the functionality of overspray arresting filters in ways not even envisioned a decade ago. For several decades, the only real scientific means for evaluating the relative performance of arresting filters for overspray paints was a, recognized but somewhat (by today's standards) crude, qualitative test procedure commonly known as an "arrestance efficiency" test. This test was and still continues to be conducted by independent filter testing laboratories.

With the increased public focus on environmental issues and the resulting regulations, overspray arrestor filter manufacturers developed what they considered to be more efficient filters. However, neither the manufacturers nor the test laboratories had a means to fully quantify the actual performance of these "more efficient" arresting filters. While existing test procedures found very little difference between various competitive arresting filters, users reported significant functional differences between them.

In the early 1990's, the assignee of the present application, Chemco Manufacturing Company, Inc. of Northbrook, Illinois, initiated an effort to find a new and more effective way to evaluate its arresting filters and, more importantly, to produce performance data that would provide a qualitative basis for its product development process. As a result of this initiative, a test protocol was developed for measuring the efficiency of an overspray filter as a function of the number and size of the actual paint droplets that impinges on a test filter. The data produced by this type of test provided new insights in the arrestance process.

One of the unexpected, but consistent, findings of the new test procedure was that while most overspray arresting filters are fairly effective in stopping the larger sized droplets (i.e., those greater than 10 microns in diameter), a significant amount of smaller diameter particles (i.e., those having a diameter in the range of 0.25–2.5 microns) were present in the air stream being exhausted from a paint booth. The presence of these low mass droplets in the air stream exiting an arresting filter could present a problem because the low mass to surface area ratio of these droplets results in the droplets remaining entrained in the exhaust air stream from the spray booth long enough to be carried out in that exhaust stream and thus expelled into the atmosphere.

Upon this realization, attempts were made to minimize or even to eliminate this phenomenon. Consideration was given to utilizing an externally generated electrostatic field to capture the problematic smaller droplets. However, the paint overspray accumulated on the electrical connection between the generating device and the individual overspray collection filters at an unacceptable rate (the filter had to be changed as frequently as every four hours of use). As a result, the use of an external power supply to maintain an electrostatic field to capture the smaller droplets was not deemed to be practical.

Another way that was considered for entrapping these smaller sized droplets involved the use of an electrostatic field generating concept known in the fibers trade as "electret." Basically, an electret media is considered either a media that contains a permanent electrostatic charge imparted onto the media when it is being manufactured or a media compromised of an appropriate combination of dissimilar fibers which generates an electrostatic charge by virtue of the friction generated when air passes in very close proximity to those dissimilar fibers. In the first case, the media must be constructed of a dielectric fiber capable of holding an electrostatic charge for years. Polypropylene has been proven to be a suitable material for use in such permanently charged media. In the second case, the requisite electrostatic charge is generated by the passage of the air being filtered through a non-woven media fabricated from a blend of dielectric fibers of opposite polarities such as modacrylic and polypropylene. However, it was found that the paint overspray accumulated on this electret media to such an extent that it neutralized the desired electrostatic effect of the electret media at an unacceptable rate when the electret media was used alone as an overspray filter.

Accordingly, it is an object of the present invention to provide a new and improved overspray paint filter media for the exhaust of an overspray paint booth.

It is another object of the present invention to provide a new and improved air filtration media for capturing and retaining airborne particulates including in particular finely atomized droplets of liquid coating materials from an air stream being exhausted from an overspray paint booth.

It is yet another object of the present invention to provide a new and improved a filter media for removing airborne particulates from an air stream being exhausted from an overspray paint booth that includes both an overspray collection filter and an electret type of electrostatic filter.

SUMMARY OF THE INVENTION

In accordance with these and many other objects of the present invention, an overspray paint air filter which is used in removing liquid paint overspray particles from an air stream being exhausted from an overspray paint booth and which embodies the present invention includes an electrostatic charged (irrespective of how that charge may be generated) media used in conjunction with and positioned downstream of a high efficiency, high holding capacity overspray collection filter. The filter is designed to capture and retain virtually all of the overspray particulates contained in an air stream being exhausted from an overspray booth. The upstream overspray collection filter should be optimized to collect the overwhelming majority of the overspray particulates to ensure that particulates do not accumulate in the electret media at an unacceptable rate.

While different types of upstream overspray collection filters can be used, a mid-weight fiberglass overspray arrestor filter can be used which is formed either as a single, homogenous filter or as a multistage progressive filter. The downstream overspray media can be formed of a separate ply of pre-charged, 100 gram electret media and is equally functional regardless if it is packaged as pads or as rolls. In one embodiment of the present invention, the electret media is mechanically attached to the downstream side of one or more such high efficiency primary overspray collection filters. In another embodiment, the electret media can be positioned a distance downstream of the primary filter as long as the exhaust air stream that passes through the primary filter then is directed through the electret media before being vented to the atmosphere.

BRIEF DESCRIPTION OF THE DRAWING

These and many other objects and advantages of the present invention will become readily apparent from consideration of the following detailed description of the embodiments of the invention shown in the accompanying drawing wherein.

DETAILED DESCRIPTION OF THE PREFERRED EMBODIMENT

Figure 1:
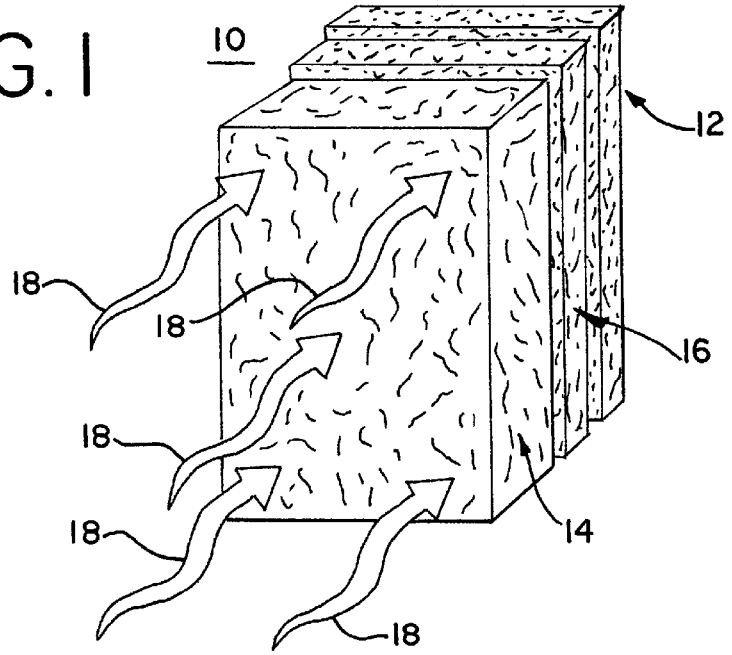
FIG. 1 is a perspective view of an overspray air filter embodying the present invention.

Referring now more specifically to FIG. 1 of the drawings, therein is disclosed a paint overspray exhaust air filter that is used in removing liquid paint overspray particles from an air stream being exhausted from an overspray paint booth, that is generally designated by the reference numeral 10 and that embodies the present invention. The overspray air filter 10 includes an electrostatic charged media 12 used in conjunction with and positioned downstream of a high efficiency, high holding capacity overspray collection filter consisting, in the case of the overspray air filter illustrated in FIG. 1, of a primary overspray collection filter 14 and a secondary overspray collection filter 16. The overspray air filter 10 is designed to capture and retain a significant portion of any overspray particulates contained in an air stream (represented in FIG. 1 by arrows 18) being exhausted from a paint overspray booth (not shown in the drawings). It is the combination of an overspray collection filter (either the primary overspray collection filter 14 or the primary overspray collection filter 14 and the secondary overspray collection filter 16) and the electrostatic charged media 12 that results in the overspray air filter 10 in being able to collect the overwhelming majority of the overspray particulates in the air stream 18 while ensuring that the electrostatic charged media 12 is not prematurely loaded (i.e., the particulates do not accumulate in the media 12 at an unacceptable rate).

Different types of upstream overspray collection filters 14 and 16 can be used. For example, the primary filter 14 can be made of a variable density, spun woven fiberglass material and the secondary filter 16 can be made of a non-woven polyester material. Otherwise, the filters 14 and 16 can be constructed from one or more of media materials commonly used for overspray filters including, but not limited to, paper, cardboard, polyester, fiberglass and Styrofoam as well as combinations thereof. One such filter that is suitable for filters 14 and 16 is a mid-weight fiberglass overspray arrestor filter sold by the assignee of the present application, Chemco Manufacturing Company, Inc. of Northbrook, Ill., known as its 18WC filter. In the case of the overspray air filter 10 illustrated in FIG. 1, the primary filtration consists of the primary overspray collection filter 14 and the secondary overspray collection filter 16. However, a single, homogenous filter could be used depending on the particular application. No matter what the configuration of the filters 14 and 16, the primary filtration portion of the filter 10 should be designed to entrapped at least a large percentage of what might be termed relatively large particulates or droplets (i.e., those that are at least 10 microns in diameter) in the air stream 18. By having the filters 14 and 16 capture those sized particulates in the air stream 18, the electrostatic charged media 12 will not be overtaxed so as to ensure that overspray paint and the like in the air stream 18 will not accumulate in the electrostatic charged media 12 at an unacceptable rate.

The downstream electrostatic charged media 12 can be formed of a separate ply of electret media. For example, the electrostatic charged media 12 can be a pre-charged, 100 gram electret media and can be either the type having a permanent electrostatic charge imparted onto it when it is being manufactured or the type compromised of an appropriate combination of fibers which generates an electrostatic charge by virtue of the friction generated when the air stream 18 passes in very close proximity to the fibers. In either case, the electrostatic charge is pregenerated in the electret media or is generated by the electret media without any external device or circuitry being used when the overspray air filter is being used in connection with the air stream 18 being exhausted from a paint spray booth. In the case where the media 12 has a permanent electrostatic charge, the media 12 is constructed of a dielectric fiber capable of holding an electrostatic charge for years. Polypropylene is one type of material suitable for such a media 12. In the case where the electrostatic charge is generated by the passage of the air stream 18 through the media 12, the media 12 can be fabricated from a blend of dielectric fibers of opposite polarities such as modacrylic and polypropylene.

Whatever electret media is used for the media 12, the media 12 tends to entrap any particulates that are still left in the air stream 18 after it flows through the primary filters 14 and 16. In particular, the electret media 12 tends to entrap particulates such as paint droplets that are as small as 0.25–2.5 microns in diameter. As a result, the combination of the primary filters 14 and 16 and the downstream electret media 12 tends to entrap or arrest essentially all of the particulates in the air stream 18 flowing from an overspray paint booth.

As is discernible from FIG. 1 of the drawings, the primary filters 14 and 16 and the electret media 12 can be positioned adjacent to each other but separated from each other a small distance. In fact, all that is necessary is for the electret media 12 to be positioned downstream of the primary filters 14 and 16 so that the exhaust air stream 18 that flows through the primary filters 14 and 16 also flows through the electret media 12 before the air stream 18 is exhausted to atmosphere. On the other hand, the primary filters 14 and 16 and the electret media 12 can be mechanically attached to each other.

Figure 2:
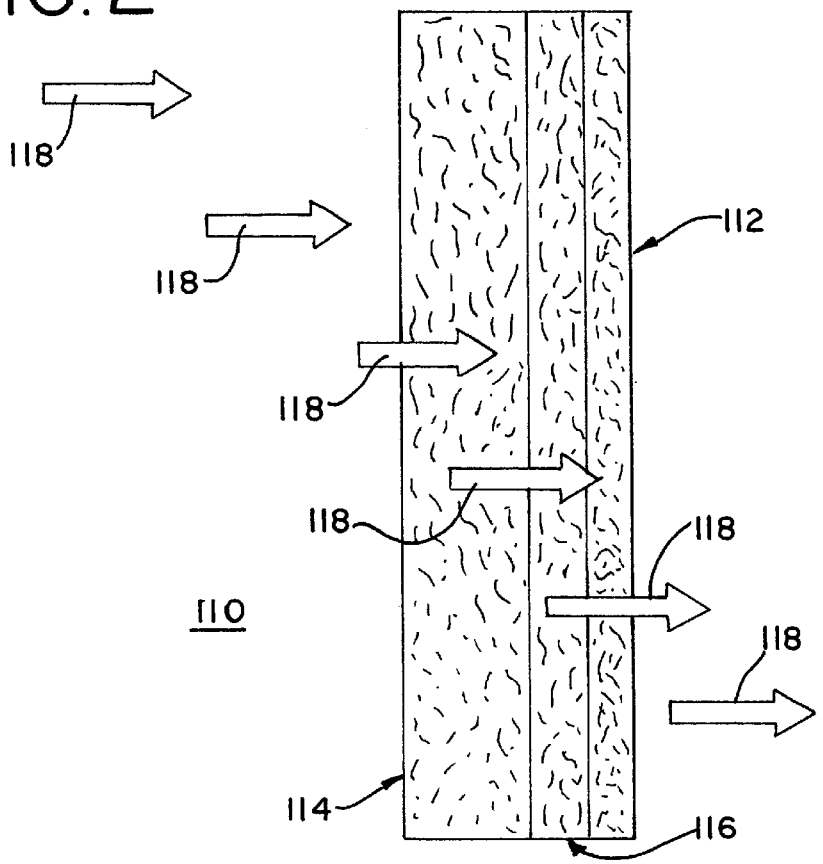
FIG. 2 is side cross sectional view of an alternate embodiment of an overspray air filter embodying the present invention.

In this regard, another, but similar overspray air filter 110 is illustrated in FIG. 2 of the drawings. The overspray air filter 110 also embodies the present invention and includes essentially the same components as the overspray air filter 10 illustrated in FIG. 1. Consequently, the components of the overspray air filter 10 and the overspray air filter 110 that are specifically referred to herein are referenced by the same reference numerals as the corresponding components in the overspray air filter 10 except that the quantity 100 has been added to those reference numerals.

In the case of the overspray air filter 110, an electret media 112 is positioned on the downstream side of an primary filter 114 and an secondary filter 116 such that an air stream 118 being exhausted from a paint spray booth (not shown) travels through the filters 114 and 116 as well as the electret media 112. However, the filters 114 and 116 are physically attached together and the electret media 112 is physically attached to the downstream side of the secondary filter 116. The attaching of the electret media 112 to the secondary filter 116 or in the case where the secondary filter 116 is not used, to the primary filter 114, can be accomplished in a number of recognized ways without dissipating the imbedded electrostatic charge in the electret media 112. These attachment methods include distributive adhesive bonding, bonding by applying intermittent droplets of hot melt adhesive, sewing and a mechanical process known as needling (intertwining individual fibers of adjacent, but different plies).

The disclosed overspray air filters 10 and 110 are illustrated in pad form. However, they can be equally functional if packaged in roll form. The specific application for which the overspray air filter 10 or 110 is being used will determine in what form it should be made.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. A spray booth with a spray booth overspray exhaust air filter for removing liquid paint particulates from an air stream being exhausted from said spray booth, said overspray exhaust air filter comprising:

a primary collection filter through which said air stream with said liquid paint particulates flows and which is adapted to entrap at least some of said particulates of at least a given size; and an electret media mechanically attached to said primary filter and positioned relative to said primary collection filter such that said air stream flows through said electret media after said air stream flows through said primary collection filter so as to entrap at least some of said particulates remaining in said air stream of a size less than said given size.

2. A spray booth overspray exhaust air filter as set forth in claim 1 wherein said primary filter and said electret media are mechanically attached by distributive adhesive bonding, by intermittent droplets of hot melt adhesive, by sewing or by needling.

3. A spray booth overspray exhaust air filter as set forth in claim 1 including a secondary collection filter interposed between said primary filter and said electret media, said secondary filter adapted to entrap at least some of said particulates remaining in said air stream of at least said given size.

4. A spray booth overspray exhaust air filter as set forth in claim 3 wherein said secondary filter and said electret media are mechanically attached.

5. A spray booth overspray exhaust air filter as set forth in claim 4 wherein said secondary filter and said electret media are mechanically attached by distributive adhesive bonding, by bonding with intermittent droplets of hot melt adhesive, by sewing or by needling.

6. A spray booth overspray exhaust air filter as set forth in claim 3 wherein said secondary filter is made of one or more of materials from the group consisting of paper, cardboard, polyester, fiberglass and Styrofoam.

7. A spray booth overspray exhaust air filter as set forth in claim 1 wherein said primary filter is made of one or more of materials from the group consisting of paper, cardboard, polyester, fiberglass and Styrofoam.

8. A spray booth overspray exhaust air filter as set forth in claim 1 wherein said electret media has an electrostatic charge applied thereto prior to being used in connection with said air stream being exhausted from said overspray booth.

9. A spray booth overspray exhaust air filter as set forth in claim 1 wherein said electret media generates an electrostatic charge due to the flow of said air stream through said electret media.

10. A spray booth overspray exhaust air filter as set forth in claim 1 wherein said electret media is made of a blend of dielectric fibers of opposite polarities.

11. A spray booth overspray exhaust air filter as set forth in claim 10 wherein said dielectric fibers include modacrylic and polypropylene.

12. A spray booth overspray exhaust air filter as set forth in claim 1 wherein said electret media is made of polypropylene.

* * * * *